US010023928B2

(12) United States Patent
Wang et al.

(10) Patent No.: US 10,023,928 B2
(45) Date of Patent: Jul. 17, 2018

(54) 700MPA-LEVEL HIGH-STRENGTH HOT ROLLING Q AND P STEEL AND MANUFACTURING METHOD THEREOF

(71) Applicant: BAOSHAN IRON & STEEL CO., LTD., Shanghai (CN)

(72) Inventors: Huanrong Wang, Shanghai (CN); Zigang Li, Shanghai (CN); Wei Wang, Shanghai (CN); Jiansu Zhang, Shanghai (CN); Jianye Li, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 223 days.

(21) Appl. No.: 14/769,647

(22) PCT Filed: Mar. 13, 2014

(86) PCT No.: PCT/CN2014/073344
§ 371 (c)(1),
(2) Date: Aug. 21, 2015

(87) PCT Pub. No.: WO2014/166323
PCT Pub. Date: Oct. 16, 2014

(65) Prior Publication Data

US 2016/0017449 A1 Jan. 21, 2016

(30) Foreign Application Priority Data

Apr. 9, 2013 (CN) ..... 2013 1 0121568

(51) Int. Cl.
*C21D 1/84* (2006.01)
*C22C 38/02* (2006.01)
(Continued)

(52) U.S. Cl.
CPC ..... *C21D 1/84* (2013.01); *C21D 6/005* (2013.01); *C21D 6/008* (2013.01); *C21D 7/13* (2013.01);
(Continued)

(58) Field of Classification Search
CPC ..... C21D 8/00; C21D 8/0226; C21D 8/0263; C22C 33/04; C22C 38/001
(Continued)

(56) References Cited

FOREIGN PATENT DOCUMENTS

CN 1688725 A 10/2005
CN 102226248 A 10/2011
(Continued)

OTHER PUBLICATIONS

NPL-1: Moor et al., Effect of Carbon and Manganese on the Quenching and partitionaing response of CMnSi steels, ISIJ International, vol. 51 (2011), No. 1, pp. 137-144.*
(Continued)

*Primary Examiner* — Jie Yang
(74) *Attorney, Agent, or Firm* — Quarles & Brady LLP

(57) ABSTRACT

A 700 Mpa-level high-strength hot rolling Q&P steel and the method of manufacturing the same, which steel has the chemical compositions in weight percentage as follows: C: 0.15%~0.40%; Si: 1.0%~2.0%; Mn: 1.5%~3.0%; P: less than or equal to 0.015%; S: less than or equal to 0.005%; Al: 0.3%~1.0%; N: less than or equal to 0.006%; Ti: 0.005%~0.015%, the remainders being Fe; it having a yield strength of more than or equal to 700 Mpa, a tensile strength of more than or equal to 1300 Mpa and an elongation rate of more than 10%. Through reasonable design on the compositions and on the basis of the compositions of common C—Mn steel, the present invention improves the content of Si to restrict the precipitation of cementite, performs the micro-Ti treatment to refine the austenite grains, and
(Continued)

improves the content of Al to quicken the austenite transformation dynamics during the air cooling process; at the same time, combines the hot rolling process with the staged cooling process to obtain the structures of proeutectoid ferrite plus martensite plus retained austenite and reduces the cost of alloy elements substantially.

5 Claims, 3 Drawing Sheets

(51) Int. Cl.

| | |
|---|---|
| ***C22C 38/04*** | (2006.01) |
| ***C22C 38/06*** | (2006.01) |
| ***C22C 38/14*** | (2006.01) |
| ***C21D 8/02*** | (2006.01) |
| ***C21D 6/00*** | (2006.01) |
| ***C21D 7/13*** | (2006.01) |
| ***C21D 8/00*** | (2006.01) |
| ***C22C 33/04*** | (2006.01) |
| ***C22C 38/00*** | (2006.01) |
| *C21D 9/46* | (2006.01) |

(52) U.S. Cl.
CPC ..... *C21D 8/005* (2013.01); *C21D 8/0226* (2013.01); *C21D 8/0263* (2013.01); *C22C 33/04* (2013.01); *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *C21D 8/00* (2013.01); *C21D 9/46* (2013.01); *C21D 2211/001* (2013.01); *C21D 2211/005* (2013.01); *C21D 2211/008* (2013.01)

(58) Field of Classification Search
USPC ..... 148/546
See application file for complete search history.

(56) References Cited

FOREIGN PATENT DOCUMENTS

| | | | | |
|---|---|---|---|---|
| CN | 102959119 | A | 3/2013 | |
| CN | 103215516 | A | 7/2013 | |
| EP | 2546382 | A1 * | 1/2013 | ..... C21D 9/46 |
| JP | 2011214069 | A | 10/2011 | |

OTHER PUBLICATIONS

PCT International Search Report, PCT/CN2014/073344, dated Jun. 23, 2014.

* cited by examiner

700MPA-LEVEL HIGH-STRENGTH HOT ROLLING Q AND P STEEL AND MANUFACTURING METHOD THEREOF

CROSS-REFERENCE TO RELATED APPLICATIONS

This application represents the national stage entry of PCT International Application No. PCT/CN2014/073344 filed Mar. 13, 2014, which claims priority of Chinese Patent Application No. 201310121568.4 filed Apr. 9, 2013, the disclosures of which are incorporated by reference here in their entirety for all purposes.

TECHNICAL FIELD

The present invention belongs to the field of wear-resistant steel and particularly, relates to a 700 Mpa-level high-strength hot rolling Q&P steel, which has a yield strength of more than or equal to 700 Mpa, a tensile strength of more than or equal to 1300 Mpa, and an elongation rate of more than 10%, and a method of manufacturing the same.

BACKGROUND

Quenching-partitioning steel, i.e., Q&P steel, is a research focus in the field of high strength steel in the past decade, which aims most importantly for improving the strength and plasticity of the steel simultaneously, that is, for improving the product of strength and plasticity of the steel. Currently, it is generally recognized that Q&P steel is an important new steel among the third generation of advanced high-strength steel in the field of automotive steel.

The primary processes of Q&P steel are: heating the steel to completely austenitic area or partially austenitic area; after performing homogenization treatment for a period of time, quenching rapidly to a temperature between Ms and Mf (Ms and Mf indicates respectively the start and end temperatures of the martensite transformation), so as to obtain the martensite plus retained austenite structure with a certain amount of retained austenite structure; subsequently preserving heat at the cease cooling temperature of the quenching or a temperature slightly higher than the cease cooling temperature for a period of time, so as to spread the carbon atom from the oversaturated martensite into the retained austenite, thus stabilizing the retained austenite; then quenching again to the room temperature.

The initial research and application of Q&P steel focused on the demand of the automobile industry on the high-strength and high-plasticity steel. It is not difficult to see from the processes of Q&P steel that its process line is complicated, and after the steel sheet is subjected to the first quenching, it needs to be rapidly heated up to a temperature and kept for a period of time. This two-stage Q&P process is difficult to be implemented for the hot rolling manufacturing process, but gives a good reference for manufacturing the hot rolling high-strength steel. During the hot rolling, one-stage Q&P process can be used, that is, after the finish rolling, the steel is reeled subsequent to being online quenched to a certain temperature below Ms. The typical structures of Q&P steel are martensite plus a certain amount of retained austenite, thereby presenting high strength and good plasticity.

China patent CN102226248A discloses a C—Si—Mn hot rolling Q&P steel, but with respect to the design of alloy element, no micro-Ti treatment is carried out; China patent CN101775470A discloses a manufacturing process of the complex-phase Q&P steel, which is actually a two-stage process of manufacturing Q&P steel; China patent CN101487096A discloses a C—Mn—Al Q&P steel, which features chiefly in high elongation rate but low strength.

The above patents use the heat treatments and control easily the volume fraction of ferrite through heating in two phase areas; but for the continuous hot rolling, the heating temperature is generally in the complete austenite area and the finishing temperature is generally above 780° C., while the start precipitating temperature of ferrite is mostly below 700° C. Consequently, it is difficult to implement in the actual hot rolling that ferrite is obtained by lowering the finish rolling temperature.

SUMMARY

The objective of the present invention is to provide a 700 Mpa-level high-strength hot rolling Q&P steel and a method of manufacturing the same, which steel has a certain amount of ferrite, martensite, and a certain amount of retained austenite structure, and presents excellent comprehensive performance; which steel has a yield strength of more than or equal to 700 Mpa, a tensile strength of more than or equal to 1300 Mpa, and an elongation rate of more than 10%; and which steel has a substantially reduced alloy cost, and can be applied in the field of requiring good deformability and medium wear resistance.

The design concept of the present invention is as follows:

Through reasonable design on the compositions and on the basis of the compositions of common C—Mn steel, the present invention improves the content of Si to restrict the precipitation of cementite, performs the micro-Ti treatment to refine the austenite grains, and improves the content of Al to quicken the austenite transformation dynamics during the air cooling process; at the same time, combines the hot rolling process with the staged cooling process to obtain the structures of proeutectoid ferrite plus martensite plus retained austenite. Through controlling the relative contents of the three different phases, high-strength hot rolling Q&P steel with a yield strength of more than or equal to 700 Mpa and a tensile strength of more than or equal to 1300 Mpa could be obtained.

Particularly, the technical solution of the present invention is:

A 700 Mpa-level high-strength hot rolling Q&P steel has the chemical compositions in weight percentage as follows: C: 0.15%~0.40%; Si: 1.0%~2.0%; Mn: 1.5%~3.0%; P: less than or equal to 0.015%; S: less than or equal to 0.005%; Al: 0.3%~1.0%; N: less than or equal to 0.006%; Ti: 0.005%~0.015%, and the remainders being Fe and other unavoidable impurities; the 700 Mpa-level high-strength hot rolling Q&P steel has a yield strength of more than or equal to 700 Mpa, a tensile strength of more than or equal to 1300 Mpa and an elongation rate of more than 10%.

Preferably, the hot rolling Q&P steel comprises the chemical compositions in weight percentage: Si: 1.3~1.7 wt %; Mn: 1.8~2.5 wt %; N: less than or equal to 0.004 wt %; Ti: 0.008~0.012 wt %; 0: less than or equal to 30 ppm.

The functionalities and contents limitations of the chemical compositions of the 700 Mpa-level high-strength hot rolling Q&P steel according to the present invention are as follows:

Carbon: carbon is the most basic element in steel, and at the same time, it is also one of the most important elements in the 700 Mpa-level high-strength hot rolling Q&P steel. Carbon acts as the interstitial atom in the steel and plays a very important role in improving the strength thereof, having the largest influence to the yield strength and the tensile strength of the steel. Generally, the higher the strength of the steel is, the lower the elongation rate is. For ensuring that the high-strength steel with a tensile strength of above 1000 Mpa, the content of carbon in the steel is generally not less than 0.15%. Too low carbon content cannot ensure that carbon spread fully from the oversaturated martensite to the retained austenite during the slow cooling process after the steel sheet is quenched and reeled, thereby affecting the stability of the retained austenite. The carbon content in the steel should not be too high, and when it is higher than 0.4%, although the high strength of the steel is ensured, due to the present invention is to obtain a certain amount of proeutectoid ferrite plus martensite plus retained austenite, the precipitation of the proeutectoid ferrite will inevitably result in that the remained austenite having not transformed become carbon-rich. The carbon-rich martensite obtained after the part of austenite is quenched has a too low elongation rate, such that the final steel sheet presents a lower elongation rate. Therefore, the appropriate carbon content in the steel should be controlled to be in 0.15~0.4 wt %, which can guarantee the matching of good strength and plasticity of the steel sheet.

Silicon: silicon is the most basic element in steel and also the most important element in the steel of the present invention. Comparing with the traditional high-strength hot rolling steel, the current high-strength hot rolling steels use basically the composition design principle of high Si. In addition to C, Si, Mn, no or only few other alloy elements are added. Si can restrict the precipitation of cementite in a certain temperature range, but has a limited restriction on the ε carbide. Si restricts the precipitation of cementite such that carbon atoms spread from the martensite into the retained austenite to stabilize the retained austenite. Although the addition of high Al and P can also restrict the precipitation of cementite, high Al content may make the molten steel viscous, and when in the continuous casting, it is prone to blocking the water gap, and reducing the efficiency of casting steel; high P content may tend to result in the brittleness of the grain boundary, whereby the impact toughness of the steel sheet is very low. Accordingly, the composition design of high Si content is still one of the most important principles in the composition designs of hot rolling Q&P steel. The content of Si is generally not less than 1.0 wt %, or the precipitation of cementite cannot be restricted; the content of Si should also be not more than 2.0 wt %, or there will be cracks when the steel sheets are welded, which will give rise to the difficulties on the application of steel sheets. Accordingly, the content of Si in the steel of the present invention is controlled to be between 1.0~2.0 wt %, preferably, between 1.3~1.7 wt %.

Manganese: manganese is the most basic element in steel and also the most important element in the steel of the present invention. It is well known that Mn is an important element for enlarging the austenite phase area, and can decline the critical quenching velocity, stabilize austenite, refine grains, and delay the transformation from austenite to pearlite. The present invention controls the Mn contents to be generally above 1.5 wt % for ensuring the strength of the steel sheet, and if the Mn content is too low, during the air cooling of the first stage in the staged cooling, the supercooling austenite becomes unstable, and is likely to transform to the structure of the pearlite type; at the same time, the Mn content should not be more than 3.0 wt %, or when in the steelmaking process, Mn segregation is usually found, and when a slab is subjected to the continuous casting, thermal cracking is likely to occur, which is not good for the improvement of the manufacturing efficiency. Accordingly, the content of Mn in the steel of the present invention is generally controlled to be between 1.5~3.0 wt %, preferably, between 1.8~2.5 wt %.

Phosphorus: phosphorus is an impurity element in the steel. P tends extremely to cluster onto the grain boundary, and when the content of P is too high (more than or equal to 0.1 wt %), $Fe_2P$ precipitates around the grains and reduces the plasticity and toughness of the steel, whereby the lower its content is, the better, and generally controlled to be less than 0.015 wt %, which is suitable and does not increase the cost of steelmaking.

Sulphur: sulphur is an impurity element in the steel, and often combines with Mn to form MnS inclusion, especially when the contents of S and Mn are both high, a lot of MnS may form in the steel, but MnS itself has some plasticity, and may deform along a rolling direction during the subsequent rolling, which declines the transverse stretching performance of the steel sheet. Accordingly, the lower the content of S is, the better, and in the actual production, is generally controlled to be less than 0.005 wt %.

Aluminum: Aluminum is one of the most important alloy elements in the steel of the present invention. The basic function of Al is to deoxidize in the steelmaking process. Additionally, Al can also combine with N in the steel to form AlN and refine grains. Beside the above functions, the addition of more Al aims mainly for quickening the dynamics of the transformation from austenite to ferrite in the stage of air cooling during the staged cooling process, and restricting the precipitation of cementite in conjunction with Si, so as to obtain a higher amount of metastable retained austenite. If the content of Al in the steel is less than 0.3 wt %, it is difficult for ferrite to precipitate fully in the few seconds of air cooling; if the content of Al in the steel is more than 1.0 wt %, the molten steel become very viscous, and tends to block the water gap in the continuous casting process, thereby affecting the manufacturing efficiency. Accordingly, the content of Al in the steel of the present invention needs to be controlled to be in an appropriate range, for instance 0.3~1.0 wt %.

Nitrogen: nitrogen belongs to the impurity element in the steel of the present invention, and the lower the content of nitrogen is, the better. N is also an unavoidable element, and generally, the content of residue N in the steel is between 0.002~0.004 wt %. The solid soluble or free N can become stable through combining with acid soluble Al. For not increasing the steelmaking cost, the content of N can be controlled just to be less than 0.006 wt %, and preferably less than 0.004 wt %.

Titanium: the amount of the added titanium corresponds to the amount of the added nitrogen. If the contents of Ti and N are controlled to be in a low range, they may form mass of fine and disperse TiN particles in hot rolling; at the same time, the ratio of the contents Ti/N should be controlled to be less than 3.42, so as to ensure that all Ti forms TiN. Fine nanoscale TiN particles with good high-temperature stability, can refine the austenite grains during the rolling; if Ti/N is more than 3.42, coarse TiN particles may tend to form in the steel, which affect adversely the impact toughness of the steel sheet and which may be the source of cracking. Besides, the content of Ti should not be too low, or the amount of TiN may be too few, unable to refine the austenite grains. Accordingly, the content of Ti in the steel of the present invention should be controlled to be in an appropriate range, that is, the addition of Ti should be between 0.005~0.015 wt %, preferably between 0.008~0.012 wt %.

Oxygen: oxygen is an unavoidable element in the steelmaking, and for the present invention, the content of 0 in the steel after Al deoxidizing can generally be under 30 ppm, which has no apparent adverse effect to the steel. Accordingly, the content of O in the steel of the present invention should be controlled to be under 30 ppm.

The method of manufacturing the 700 Mpa-level high-strength hot rolling Q&P steel of the present invention, comprises specifically the following stages:

1) smelting, secondary refining, and casting:

smelting by a converter or electric furnace as the following compositions, secondary refining by a vacuum furnace, and casting to form a casting blank or casting ingot, wherein the chemical compositions in weight percentage are as follows: C: 0.15%~0.40%, Si: 1.0%~2.0%, Mn: 1.5%~3.0%, P: less than or equal to 0.015%, S: less than or equal to 0.005%, Al: 0.3%~1.0%, N: less than or equal to 0.006%, Ti: 0.005%~0.015%, the remainders being Fe and other unavoidable impurities;

2) heating, and hot rolling:

heating the casted blank or casted ingot obtained by the stage 1) up to 1100~1200° C., and preserving heat for 1~2 h; with the bloom rolling temperature of 1000~1100° C., performing the multi-pass rolling and the accumulating deforming amount being more than or equal to 50%, which aims mainly for refining the austenite grains; subsequently, when the intermediate billet temperature falls to 900~950° C., performing 3~5 passes of rolling and the accumulating deforming amount being more than or equal to 70%; the rolling process being shown as FIG. 2; the number of passes of the multi-pass hot rolling being for example 5~7;

3) staged cooling:

the rolled piece at the temperature between 800~900° C. being rapidly water cooled to 500~600° C. in a cooling speed of more than 50° C./s, then air cooled for 5~10 s, and subsequently cooled to a temperature between 100~300° C. (i.e. between Ms-Mf) in a cooling speed of more than 50° C./s, to obtain the structures of proeutectoid ferrite plus martensite plus retained austenite, finally cooled slowly to the room temperature afterreeling, thereby obtaining the 700 Mpa-level high-strength hot rolling Q&P steel; the post-rolling cooling process being shown in FIG. 3.

Preferably the multi-pass rolling in the stage 2) is 5~7 passes of rolling; the speed of slow cooling after reeling is 8~12° C./h.

In the structures of proeutectoid ferrite plus martensite plus retained austenite, the volume fraction of the proeutectoid ferrite is 10~20%, while the volume fraction of the retained austenite is more than 5% and less than 10%.

A steel sheet with excellent comprehensive performance may be obtained through reasonable composition designs and matching the new processes of innovative hot rolling and staged cooling, that is, a 700 Mpa-level high-strength hot rolling Q&P steel of the present invention with a yield strength of more than or equal to 700 Mpa, a tensile strength of more than or equal to 1300 Mpa and an elongation rate of more than 10% is obtained.

In the staged cooling of the present invention, the rapid water cooling in the first stage aims mainly for improving the phase transformation driving force of the overcooling austenite, so as to precipitate the sufficient proeutocoid ferrite (10~20 wt %) in the subsequent air cooling stage, to ensure a low yield strength of the steel sheet. Generally, for improving the tensile strength of the steel sheet, it is necessary to increase the contents of carbon and manganese, but carbon and manganese are elements for austenite stabilization, and the increasing of contents of carbon and manganese will certainly result in insufficient amount of or no ferrite precipitates within a limited time in the air cooling stage. Accordingly, one of the innovative point in the present invention exhibits in the composition design, that the content of aluminum is increased substantially, above ten times the content of aluminum in the general steel. The objective of the substantially increasing the content of aluminum is to quicken the precipitation of ferrite in the air cooling stage in case of high carbon and manganese content. But it is inappropriate for the content of aluminum to be too high, or the molten steel may tend to become viscous, and when casting, tend to block the water gap, and result in increasing aluminum oxide inclusion. Accordingly, the proportion of the alloy compositions, and the hot rolling, and cooling processes must be controlled well, and the higher the water cooling speed in this stage is, the better;

After the end of air cooling, the cease cooling temperature of the quenching in the second stage must be controlled to be in a temperature range rather than the room temperature, or the distribution of carbon atom cannot be finished, and the amount of retained austenite is too low, resulting in a lower elongation rate. Currently the typical online quenching process is direct quenching to the room temperature, while another innovative point of the present invention is to control the reeling temperature in a certain low temperature range such that on the one hand, high retained austenite content (more than 5 wt %) can be held, but the retained austenite is not stable, and if cooling into the room temperature, the retained austenite will be transformed into other structures, hence in the composition design, a certain amount of Si element is added so as to restrict the precipitation of carbide in the retained austenite, reducing the consumption of carbon; on the other hand, due to that the chemical potential of carbon atom in martensite is higher than that in the retained austenite, and the difference of the chemical potentials between them provides a driving force for the carbon atom to spread from martensite to the retained austenite, such that the carbon content in the retained austenite is increased remarkably, whereby the retained austenite can exist stably under the room temperature. Through the skillful matching of the composition proportion and the cooling processes, the steel sheet with a structure of a certain amount of ferrite plus martensite plus retained austenite can be obtained, such that the 700 Mpa-level high-strength hot rolling Q&P steel with excellent performance is obtained.

Additionally, if the heating temperature of the steel blank is less than 1100° C. or the heat preservation time is too short, it is adverse to the homogenization of the alloy elements; if the temperature is higher than 1200° C., the production cost will be promoted, and the heating quality of the steel blank will decline. Accordingly, it is suitable that the heating temperature of the steel blank is controlled to be between 1100~1200° C.

Similarly, it is also necessary to control the heat preservation time within a certain range. If the heat preservation time is too short, the solute atoms such as Si, Mn diffuse insufficiently, the heating quality of the steel blank cannot be guaranteed; if the heat preservation time is too long, the austenite grains may become coarse, and the production cost is improved, consequently the heat preservation time should be controlled to be between 1~2 hours. If the heating temperature is higher, the corresponding heat preservation time can be shortened appropriately.

The manufacturing process of the present invention can be used for producing the high-strength hot rolling Q&P wear-resistant steel sheet that has a yield strength of more than or equal to 700 Mpa, a tensile strength of more than or equal to 1300 Mpa and a thickness of 3~12 mm, and has good elongation rate (more than 10%). The steel sheet presents excellent matching of strength and plasticity, thereby bringing the following benefits:

1. The cost of the alloy elements of the 700 Mpa-level high-strength hot rolling Q&P steel sheet are declined substantially. Comparing with the traditional high-strength low-alloy steel, no noble metal such as Nb, V, Cu, Ni, Mo are added, which reduces substantially the alloy cost. The manufacturing cost can be further reduced by using the hot continuous rolling, comparing to the thick plate production line. Accordingly, the production cost of the steel sheet is very low.

The 700 Mpa-level high-strength hot rolling Q&P steel sheet of the present invention presents excellent mechanical properties, and the comprehensive use cost of the customer is declined. Due to the yield strength of the steel sheet is low and the tensile strength is high, the yield ratio is low. It brings about such a benefit that many high-strength steel customers need not to be modify the prior processing equipments to perform the process such as bending on the steel sheet, which saves the cost of the modified equipments; while reducing the loss of the abrasive tools and prolongs the lifetime thereof, etc.

The steel sheet of the present invention has the advantages of low cost, low yield ratio and high strength, especially suitable for the field requiring bending formation and high wear-resistance. The metastable retained austenite held in the steel can be transformed into martensite in case that the abrasive grains wear, thereby further improving the wear resistance of the steel sheet.

DETAILED DESCRIPTION

Hereinafter the technical solution of the present invention will be further described in details in conjunction with the detailed embodiments.

Figure 1:
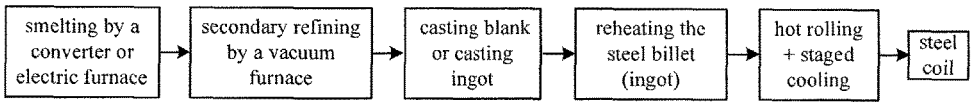
FIG. 1 is a flow chart of the manufacturing process of the 700 Mpa-level high-strength hot rolling Q&P steel sheet according to the present invention.

In the method of manufacturing the 700 Mpa-level high-strength hot rolling Q&P steel sheet according to the present invention, the production procedure thereof is as follows: smelting in a converter or electric furnace→secondary refining in a vacuum furnace→casting blank (ingot)→reheating steel billet (ingot)→hot rolling plus staged cooling processes→coiling, as shown in FIG. 1.

Embodiments

The production of the 700 Mpa-level high-strength hot rolling Q&P steel sheet in Embodiments 1~5 includes specifically the following stages:

1) smelting, secondary refining, and casting:

smelting in a converter or electric furnace as the compositions of the steels in Table 1, secondary refining in a vacuum furnace, and casting to form a casting blank or casting ingot;

TABLE 1 unit: wt %

| Embodiment No. | C | Si | Mn | P | S | Al | N | Ti | O |
|---|---|---|---|---|---|---|---|---|---|
| 1 | 0.15 | 1.55 | 2.52 | 0.006 | 0.0027 | 0.55 | 0.0032 | 0.010 | 0.0026 |
| 2 | 0.22 | 1.26 | 1.83 | 0.006 | 0.0022 | 0.83 | 0.0033 | 0.005 | 0.0024 |
| 3 | 0.28 | 1.37 | 2.95 | 0.009 | 0.0024 | 0.32 | 0.0046 | 0.015 | 0.0023 |
| 4 | 0.34 | 1.95 | 1.98 | 0.010 | 0.0023 | 0.99 | 0.0036 | 0.008 | 0.0028 |
| 5 | 0.40 | 1.72 | 1.55 | 0.012 | 0.0031 | 0.74 | 0.0040 | 0.013 | 0.0029 |

Figure 2:
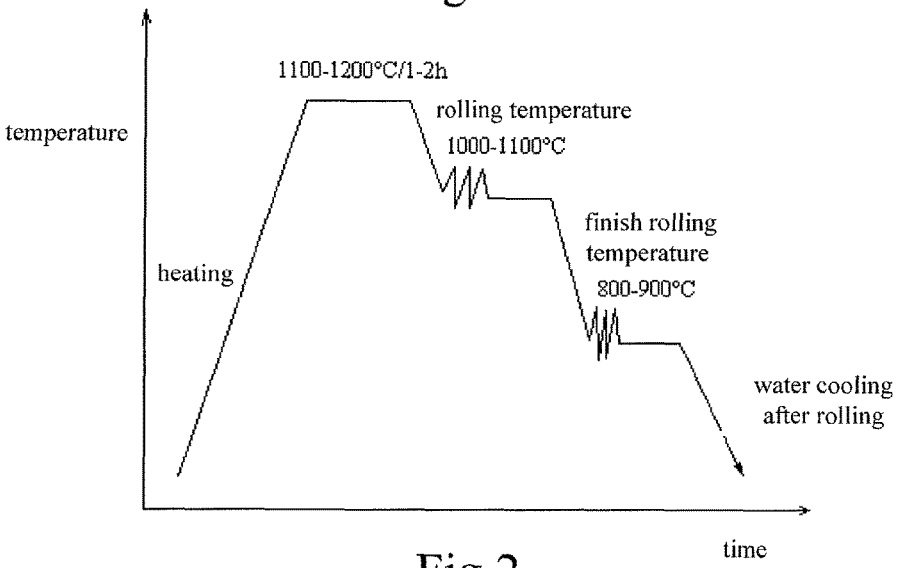
FIG. 2 is a schematic view of the rolling process of the 700 Mpa-level high-strength hot rolling Q&P steel sheet according to the present invention.

2) heating, and hot rolling:

heating the casted blank or casted ingot obtained by the stage 1) up to 1100~1200° C., and preserving heat for 1~2 h; with the bloom rolling temperature of 1000~1100° C., performing the 5~7 passes of rolling and the accumulating deforming amount being more than or equal to 50%; subsequently, when the intermediate billet temperature falls to 900~950° C., performing 3~5 passes of rolling and the accumulating deforming amount being more than or equal to 70%; the rolling process being shown as FIG. 2; the specific process parameters of hearing and hot rolling in the embodiments being shown as Table 2, and the thickness of the steel billet being 120 mm.

Figure 3:
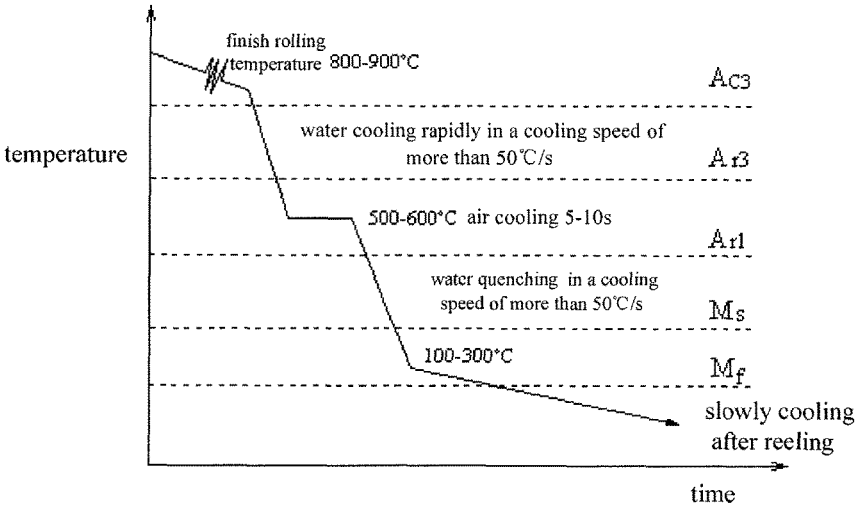
FIG. 3 is a schematic view of the post-rolling cooling process of the 700 Mpa-level high-strength hot rolling Q&P steel sheet according to the present invention.

3) staged cooling:

the rolled piece at the temperature between 800~900° C. being rapidly water cooled to 500~600° C. in a cooling speed of more than 50° C./s, then air cooled for 5~10 s, and subsequently cooled to a temperature between 100~300° C. (i.e. between Ms-Mf) in a cooling speed of more than 50° C./s, to obtain the structure of a certain amount of ferrite plus martensite plus a certain amount of retained austenite, finally cooled slowly to the room temperature after reeling, thereby obtaining the 700 Mpa-level high-strength hot rolling Q&P steel of the embodiments; the post-rolling cooling process being shown in FIG. 3; the specific post-rolling process parameters in the embodiments being shown as Table 2.

Through testing, the mechanical properties of the 700 Mpa-level high-strength hot rolling Q&P steel of Embodiments 1~5 are shown as Table 3. The typical metallographs of the 700 Mpa-level high-strength hot rolling Q&P steel in Embodiments 1,3,5 are shown respectively as FIG. 4 to FIG. 6.

TABLE 2

| Embodiment No. | Heating Temp. (° C.) | Finish Rolling Temp. (° C.) | Thickness of Steel Sheet (mm) | Cease Cooling Temp. in First Stage (° C.) | Air Cooling Time. in Second Stage (s) | Cease Cooling Temp. in Third Stage (° C.) |
|---|---|---|---|---|---|---|
| 1 | 1150 | 840 | 3 | 590 | 6 | 250 |
| 2 | 1100 | 810 | 6 | 560 | 10 | 210 |
| 3 | 1200 | 825 | 8 | 540 | 8 | 100 |
| 4 | 1150 | 900 | 10 | 520 | 6 | 150 |
| 5 | 1200 | 880 | 12 | 500 | 5 | 300 |

TABLE 3

| Mechanical Properties of Steel Sheet | | | | |
|---|---|---|---|---|
| Embodiment | Yield Strength MPa | Tensile Strength MPa | Elongation rate % | Yield Ratio |
| 1 | 738 | 1324 | 12 | 0.56 |
| 2 | 818 | 1458 | 12 | 0.56 |
| 3 | 834 | 1468 | 11 | 0.57 |
| 4 | 853 | 1436 | 11 | 0.59 |
| 5 | 910 | 1513 | 10 | 0.60 |

Figure 4:
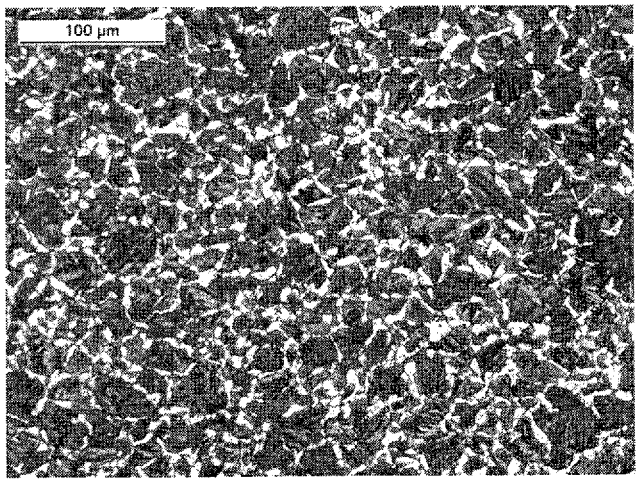
FIG. 4 is a typical metallograph of the testing steel of Embodiment 1# according to the present invention.
Figure 5:
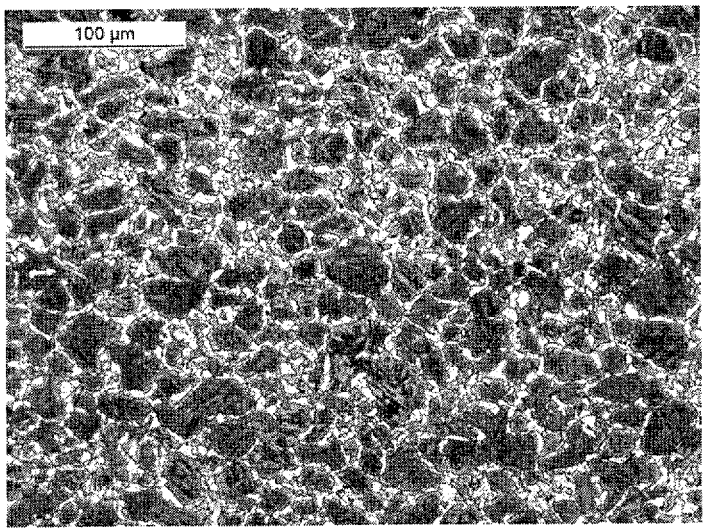
FIG. 5 is a typical metallograph of the testing steel of Embodiment 3# according to the present invention.
Figure 6:
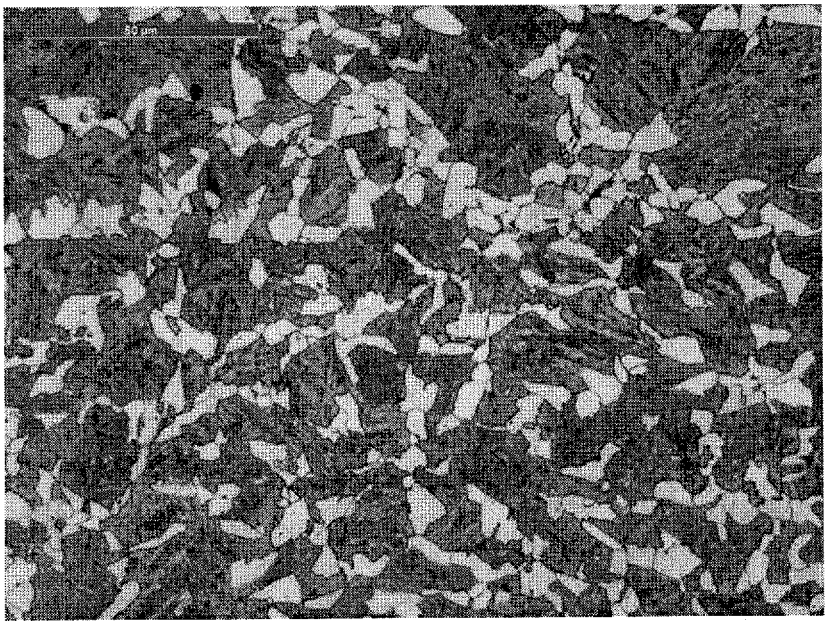
FIG. 6 is a typical metallograph of the testing steel of Embodiment 5# according to the present invention.

It can be seen from the typical metallographs of the 700 Mpa-level high-strength hot rolling Q&P steel in FIGS. 4-6 that the structures of the steel sheet are primarily isometric proeutectoid ferrite plus martensite plus retained austenite.

It is known from the results of X-ray diffraction, the volume fraction of the retained austenite in the steel sheets of Embodiments 1, 3, and 5 are respectively 5.55%, 6.78% and 8.11%. The volume fraction of the isometric proeutectoid ferrite are all between 10~20%. In the temperature range of 500~600° C., the lower the cease cooling temperature is, the more the precipitation amount of the isometric proeutectoid ferrite. Accordingly, the microstructure of the steel sheet of the present invention is the isometric proeutectoid ferrite plus martensite plus retained austenite. Due to the existence of the retained austenite, the steel sheets are subjected to the effect of transformation inducing plasticity (TRIP) during the stretching and wearing processes, whereby the wear resistance of the steel sheet is improved.

What is claimed is:

1. A 700 MPa-level high-strength hot rolling quenching-partitioning steel, consisting of a chemical composition in weight percentage as follows: C: 0.15%~0.40%; Si: 1.0%~2.0%; Mn: 1.5%~3.0%; P: less than or equal to 0.015%; S: less than or equal to 0.005%; Al: 0.3%~1.0%; N: less than or equal to 0.006%; Ti: 0.005%~0.015%, the balance being Fe and other unavoidable impurities; wherein the hot rolling quenching-partitioning steel has a yield strength of more than or equal to 700 Mpa, a tensile strength of more than or equal to 1300 Mpa and an elongation rate of more than 10%; and wherein the structure of the hot rolling quenching-partitioning steel is of proeutectoid ferrite plus martensite plus retained austenite, and the volume fraction of the proeutectoid ferrite is 10~20%, while the volume fraction of the retained austenite is more than 5% and less than 10%, wherein the ratio between the content of Ti to the content of N is less than 3.42.

2. The 700 MPa-level high-strength hot rolling quenching-partitioning steel according to claim 1, wherein the hot rolling quenching-partitioning steel comprises the chemical compositions in weight percentage: Si: 1.3~1.7 wt %; Mn: 1.8~2.5 wt %; N: less than or equal to 0.004 wt %; Ti: 0.0080.012 wt %; 0: less than or equal to 30 ppm.

3. A method of manufacturing the 700 MPa-level high-strength hot rolling quenching-partitioning steel according to claim 2, comprising specifically the following stages:

1) smelting, secondary refining, and casting:

smelting in a converter or electric furnace as the following compositions, secondary refining in a vacuum furnace, and casting to form a casting blank or casting ingot, wherein the chemical compositions in weight percentage are: C: 0.15%~0.40%, Si: 1.0%~2.0%, Mn: 1.5%~3.0%, P: less than or equal to 0.015%, S: less than or equal to 0.005%, Al: 0.3%~1.0%, N: less than or equal to 0.006%, Ti: 0.005%~0.015%, the balance being Fe and other unavoidable impurities;

2) heating, and hot rolling:

heating the casted blank or casted ingot obtained by the stage 1) up to 1100~1200° C., and preserving heat for 1~2 h; with the bloom rolling temperature of 1000~1100° C., performing the multi-pass rolling and the accumulating deforming amount being more than or equal to 50%; subsequently, when the intermediate billet temperature falls to 900~950° C., performing 3~5 passes of rolling and the accumulating deforming amount being more than or equal to 70%;

3) staged cooling:

the rolled piece at the temperature between 800~900° C. after hot rolling being rapidly water cooled to 500~600° C. in a cooling speed of more than 50° C./s, then air cooled for 5~10 s, and subsequently cooled to a temperature between 100∫300° C. (i.e. between Ms-Mf) in a cooling speed of more than 50° C./s, to obtain the structures of proeutectoid ferrite plus martensite plus retained austenite, finally cooled slowly to the room temperature after reeling, thereby obtaining the 700 MPa-level high-strength hot rolling quenching-partitioning steel.

4. A method of manufacturing the 700 MPa-level high-strength hot rolling quenching-partitioning steel according to claim 1, comprising specifically the following stages:

1) smelting, secondary refining, and casting:

smelting in a converter or electric furnace as the following compositions, secondary refining in a vacuum furnace, and casting to form a casting blank or casting ingot, wherein the chemical compositions in weight percentage are: C: 0.15%~0.40%, Si: 1.0%~2.0%, Mn: 1.5%~3.0%, P: less than or equal to 0.015%, S: less than or equal to 0.005%, Al: 0.3%-1.0%, N: less than or equal to 0.006%, Ti: 0.005%~0.015%, the balance being Fe and other unavoidable impurities;

2) heating, and hot rolling:

heating the casted blank or casted ingot obtained by the stage 1) up to 1100~1200° C., and preserving heat for 1~2 h; with the bloom rolling temperature of 1000~1100° C., performing the multi-pass rolling and the accumulating deforming amount being more than or equal to 50%; subsequently, when the intermediate billet temperature falls to 900~950° C., performing 3~5 passes of rolling and the accumulating deforming amount being more than or equal to 70%;

3) staged cooling:

the rolled piece at the temperature between 800~900° C. after hot rolling being rapidly water cooled to 500~600° C. in a cooling speed of more than 50° C./s, then air cooled for 5~10 s, and subsequently cooled to a temperature between 100∫300° C. (i.e. between Ms-Mf) in a cooling speed of more than 50° C./s, to obtain the structures of proeutectoid ferrite plus martensite plus retained austenite, finally cooled slowly to the room temperature after reeling, thereby obtaining the 700 MPa-level high-strength hot rolling quenching-partitioning steel.

5. The method of manufacturing the 700 MPa-level high-strength hot rolling quenching-partitioning steel according to claim 4, wherein the multi-pass rolling in the stage 2) is 5~7 passes of rolling; the speed of slow cooling after reeling in the stage 3) is 8~12° C./h.

* * * * *